US007489888B2

(12) United States Patent
Sato et al.

(10) Patent No.: US 7,489,888 B2
(45) Date of Patent: Feb. 10, 2009

(54) IMAGE-FORMING APPARATUS INCLUDING A CARTRIDGE LOADING SECTION IN COMMUNICATION WITH A CARTRIDGE OPENING

(75) Inventors: Shougo Sato, Seto (JP); Yasushi Okabe, Nagoya (JP); Shigeharu Katayama, Kakamigahara (JP); Yasutake Yamaguchi, Chiryu (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 344 days.

(21) Appl. No.: 11/277,480

(22) Filed: Mar. 24, 2006

(65) Prior Publication Data

US 2006/0222402 A1 Oct. 5, 2006

(30) Foreign Application Priority Data

Mar. 30, 2005 (JP) ..... 2005-099849

(51) Int. Cl.
*G03G 21/16* (2006.01)
*G03G 21/18* (2006.01)

(52) U.S. Cl. ..... 399/111; 399/125

(58) Field of Classification Search ..... 399/110, 399/111, 125
See application file for complete search history.

(56) References Cited

U.S. PATENT DOCUMENTS 6,640,069 B2 10/2003 Kanemoto
6,798,430 B2 9/2004 Sato
6,975,819 B2 12/2005 Katamoto
7,187,886 B2 * 3/2007 Kawasumi ..... 399/111
7,340,197 B2 * 3/2008 Murayama et al. ..... 399/111
7,356,283 B2 * 4/2008 Igarashi ..... 399/111
7,362,986 B2 * 4/2008 Okabe et al. ..... 399/111
2005/0047821 A1 3/2005 Murayama et al.

FOREIGN PATENT DOCUMENTS

| | | |
|---|---|---|
| CN | 1497378 A | 5/2004 |
| JP | H8 30178 | 2/1996 |
| JP | H8 305243 | 11/1996 |
| JP | 2001 337578 | 12/2001 |
| JP | 2001 356548 | 12/2001 |
| JP | 2002254670 A | 9/2002 |
| JP | 2002 287570 | 10/2002 |
| JP | H10 187002 | 7/2008 |

OTHER PUBLICATIONS

State Intellectual Property Office, First Office Action in Chinese Patent Application No. 2006100718671 (counterpart to above-captioned U.S. patent application) dated Feb. 1, 2008.
Japanese Patent Office, Office Action for Japanese Patent Application No. 2005-099849 (counterpart to the above-captioned U.S. patent application) mailed Oct. 2, 2008.

* cited by examiner

*Primary Examiner*—William J Royer
(74) *Attorney, Agent, or Firm*—Baker Botts L.L.P.

(57) ABSTRACT

An image-forming device has a main casing, a cartridge, and a guiding unit. The main casing has a cartridge access opening and a cartridge loading section in communication with the cartridge access opening. The cartridge access opening has an opening plane. The cartridge is detachably counted in the cartridge loading section through the cartridge access opening. The guiding unit provides a loading path to load/unload the cartridge with respect to the cartridge loading section. The guide unit is configured to orient the loading path toward a direction substantially parallel to the opening plane outside of the main casing, thereby curving a track of the cartridge.

24 Claims, 8 Drawing Sheets

1

IMAGE-FORMING APPARATUS INCLUDING A CARTRIDGE LOADING SECTION IN COMMUNICATION WITH A CARTRIDGE OPENING

CROSS REFERENCE TO RELATED APPLICATIONS

This application claims priority from Japanese Patent Application No. 2005-099849 filed on Mar. 30, 2005. The entire content of this priority application is incorporated herein by reference.

TECHNICAL FIELD

The present invention relates to an image-forming device, such as a laser printer, and a cartridge mounted in the image-forming device.

BACKGROUND

In a conventional image-forming device, such as a laser printer, having a main device body, a process cartridge including a photosensitive drum and a developer unit is detachably mounted in the main device body. An access opening is formed in a prescribed surface of the main device body, while a cover is disposed on the main device body for exposing and covering the access opening. This cover is rotatably supported about a shaft extending along the prescribed surface of the main device body. By rotating the cover open about the shaft, the access opening is exposed, enabling a user to linearly remove a process car-ridge from or mount a process cartridge into the main device body through the access opening. When the cover is closed about the shaft, the cover covers the access opening.

However, in an image-forming device having this construction, the cartridge cannot be mounted in or removed from the main device body unless the cover is opened wide. To open the cover wide, a large space is needed around the periphery of the main device body. Hence, the image-forming device occupies a greater space than the space required for installation, resulting in restrictions on installation locations.

In view of the foregoing, it is an object of the present invention to provide an image-forming device and a cartridge mounted in the image-forming device that are capable of Increasing the flexibility of choosing an installation location.

SUMMARY

The present invention provides an image-forming device having: a main casing, a cartridge, and a guiding unit. The main casing has a cartridge access opening and a cartridge loading section in communication with the cartridge access opening. The cartridge access opening has an opening plane. The cartridge is detachably mounted in the cartridge loading section through the cartridge access opening. The guiding unit provides a loading path to load/unload the cartridge with respect to the cartridge loading section. The guide unit is configured to orient the loading path toward a direction substantially parallel to the opening plane outside of the main casing, thereby curving a track of the cartridge.

The present invention provides an image-forming device having: a main casing, a plurality of cartridges, and a guiding unit. The main casing has a cartridge access opening and a cartridge loading section in communication with the cartridge access opening. The plurality of cartridges are detachably mounted though the cartridge access opening and arrayed in one direction in the cartridge loading section so that one end of each cartridge faces the cartridge access opening. The guiding unit provides a loading path to load/unload each of the plurality of cartridges with respect to the cartridge loading section. The guiding unit orients the loading path toward the one direction out of the main casing, thereby curving a track of each of the plurality of cartridges.

The present invention provides a cartridge loadable in an image-forming device, having a casing. The casing has a first surface and a second surface opposing the first surface by a distance. The first and second surfaces have a concentric arc cross-section in a loading direction.

BRIEF DESCRIPTION OF THE DRAWINGS

The aforementioned aspects of the invention are explained in the following description, taken in connection with the accompanying drawing figures wherein.

DETAILED DESCRIPTION

Image forming devices of embodiments according to the invention will be described with reference with the accompanied drawings. In the following description, the expressions "front","rear", "above", "below", "up", "down", "horizontal", and "vertical" are used throughout the description to define the various parts when the image forming device is disposed in an orientation in which it is intended to be used.

Figure 1:
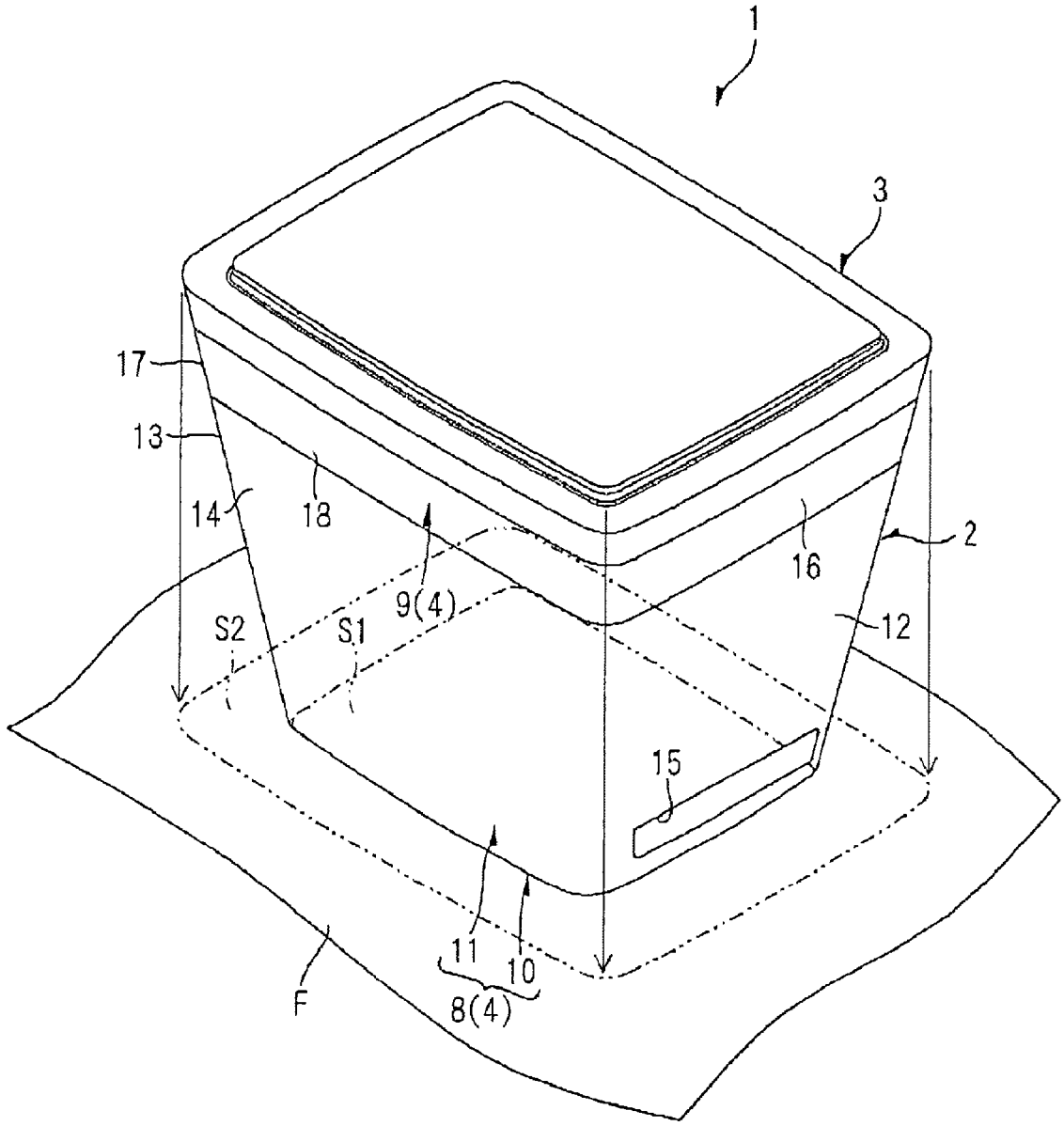
FIG. 1 is a Perspective view showing the external appearance of a multifunction device according to a first embodiment of the present invention.
Figure 2:
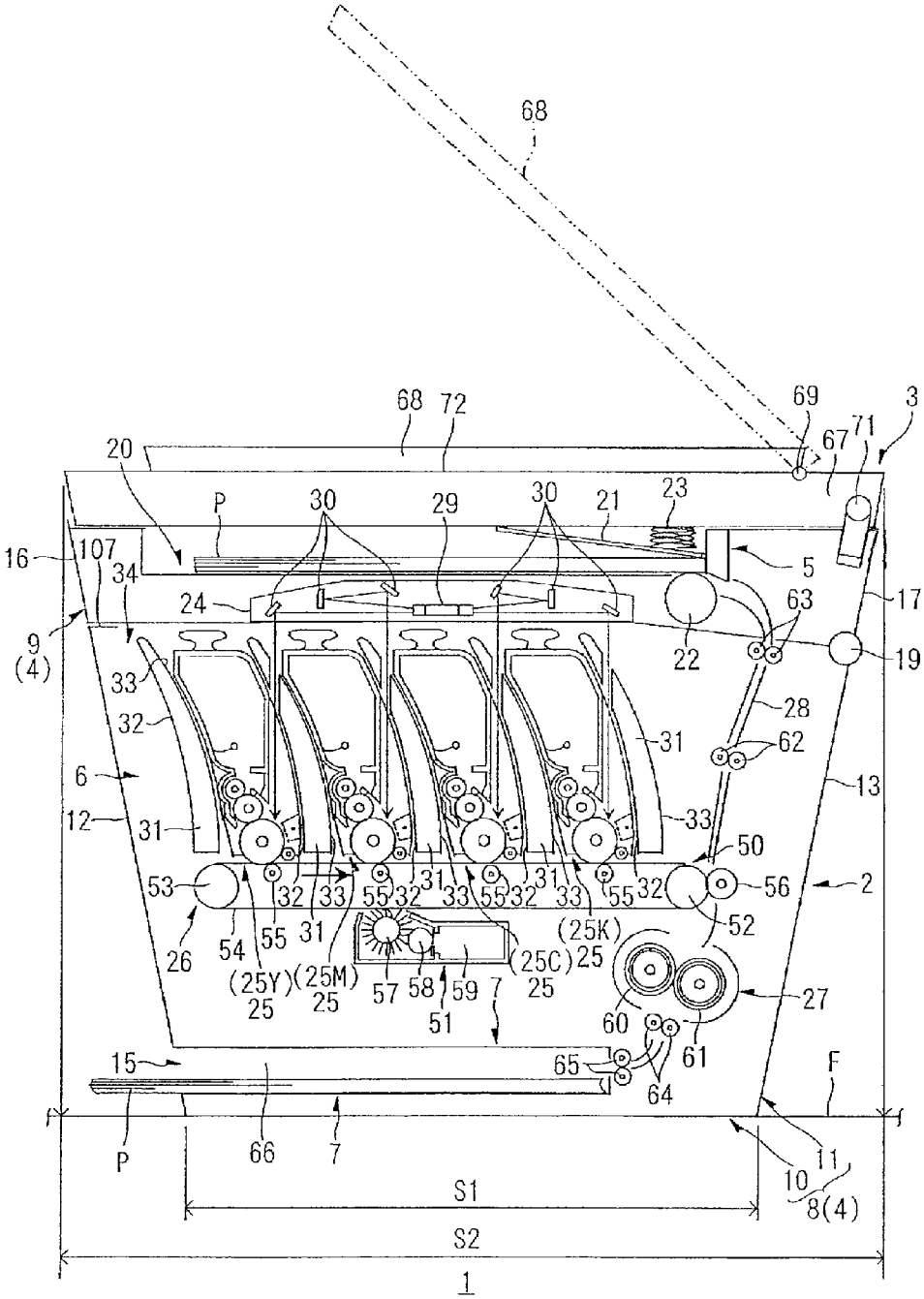
FIG. 2 is a side cross-sectional view of the multifunction device in FIG. 1, wherein a flatbed scanner and an upper casing are closed.

As shown in FIG. 1, a multifunction device 1 includes a printer 2, and a flatbed scanner 3 disposed above the printer 2. The multifunction device 1 achieves a printer function through the printer 2, a scanner function through the flatbed scanner 3, and a copier function through a combination of these functions. The multifunction device 1 is a desktop type multifunction device that can be installed on top of a desk. The overall multifunction device 1 is shaped like the base of a quadrangular pyramid that has been inverted so that the surface area of the top surface is greater than that of the bottom surface. Hence, a mounting surface area S1 of the bottom surface mounted on a mounting surface F is smaller than a projected surface area S2 of the top surface of the multifunction device 1 projected on the mounting surface F.

The printer 2 is an intermediate transfer tandem color laser printer and includes a main casing 4 and, within the main casing 4, a paper supply unit 5, an engine unit 6, and a discharge unit 7.

The main casing 4 is formed of a hard synthetic resin and is divided into a lower casing 8 and an upper casing 9.

As shown in FIGS. 1 through 5, the lower casing 8 is integrally formed of a rectangular bottom plate 10, and side plates 11 extending upward and expanding outward from the peripheral edges of the bottom plate 10. This structure of the side plate 11 is applied to a front surface 12, a rear surface 13, and side surfaces 14, resulting in forming inverted trapezoids of the main casing 4 in side views in which the length of she bottom plate 10 is shorter than the length of the upper portion of the main casing 4. The lower casing 8 also has a tow surface 107. An access opening 34 is formed in the too surface 107 for loading and unloading process cartridges 25 described later. A paper discharge opening 1; having a rectangular shape extended horizontally is formed in a lower section of the front surface 12.

The upper casing 9 has a square frame shape and is disposed on top of the lower casing 8. The upper casing 9 includes a front surface 16, a rear surface 17, and side surfaces 18 that are flush with the front surface 12, rear surface 13, and side surfaces 14 of the lower casing 8, the front surface 16, rear surface 17, and side surfaces 18 are connected to the front surface 12, rear surface 13, and side surfaces 14, respectively without a step therebetween.

A rotational shaft 19 penetrates a lower edge portion of the rear surface 17 on the upper casing 9 and extends along the upper edge of the rear surface 13 on the lower casing 8. The upper casing 9 is thus rotatably supported on the rotational shaft 19. Consequently, the upper casing 9 is capable of rotating about the rotational shaft 19 between a closed position (shown in FIG. 2) in which the lower edges of the front surface 16, rear surface 17, and side surfaces 18 contact upper edges of the front surface 12, rear surface 13, and side surfaces 14; and an open position (shown in FIG. 5) in which the front surface 16 side of the upper casing 9 is raised.

In the following description, the front surface 12 side of the lower casing 8 (the left side in FIG. 2) will be referred to as the front side, while the opposite side or rear surface 13 side (the right side in FIG. 2) will be referred to as the rear side.

As shown in FIGS. 2 through 5, the paper supply unit 5 is disposed in an upper section of the upper casing 9. The paper supply unit 5 includes a paper-accommodating depression 20 for accommodating a paper P, a paper-pressing plate 21 disposed inside the paper-accommodating depression 20, and a feeding roller 22 disposed at the lower rear edge of the paper-accommodating depression 20.

The paper-accommodating depression 20 is configured of a box-like frame having a bottom and an open top. The paper-accommodating depression 20 is fixed to the upper casing 9.

The paper-pressing plate 21 is disposed in the paper-accommodating depression 20 and extends from a left-to-right midpoint of the paper-accommodating depression 20 to a rear edge thereof. A front edge of the paper-pressing plate 21 is pivotably supported on a lower surface of the flatbed scanner 3. A compressed spring 23 is disposed on the top surface of the paper-pressing plate 21 at the rear edge thereof for urging the rear edge of the paper-pressing plate 21 downward.

The feeding roller 22 is disposed in confrontation with the rear edge of the paper-pressing plate 21 as the paper-pressing plate 21 is urged downward by the compressed spring 23.

The pacer P is accommodated in the paper-accommodating depression 20 in a stacked manner in a vertical direction. The rear edge of the paper-pressing plate 21 contacts the rear edge of the topmost sheet of paper P on the upper surface thereof. The compressed spring 23 urges the paper-pressing plate 21 so that the lower surface on the rear edge of the bottommost sheet of paper P is pressed into contact with the feeding roller 22. When the feeding roller 22 rotates, the lowermost sheet of paper P in contact with the feeding roller 22 is fed toward the engine unit 6.

The engine unit 6 includes a scanning unit 24, the process cartridges 25, a transfer unit 26, a fixing unit 27, and a conveying path 28.

The scanning unit 24 is disposed in the upper casing 9 below the paper supply unit 5. The scanning unit 24 includes a laser light-emitting unit (not shown), a plurality of lenses, a polygon mirror 29 that can be driven to rotate, and a plurality of reflecting mirrors 30.

With this construction, the laser light-emitting unit of the scanning unit 24 emits a laser beam based on prescribed image data. As indicated by the arrows in FIG. 2, the laser beam is deflected off the polygon mirror 29 and sequentially passes through or is reflected by the plurality of lenses and the reflecting mirrors 30 and is subsequently irradiated onto the surface of photosensitive drums 38 described later in each process cartridge 25.

In this embodiment, a process cartridge 25 is provided for each of four colors of toner. The process cartridges 25 are arranged parallel to each other and spaced horizontally in the front-to-rear direction in the upper section of the lower casing 8. More specifically, the process cartridges 25 include a yellow process cartridge 25Y, a magenta process cartridge 25M, a cyan process cartridge 25C, and a black process cartridge 25K. Five guiding members 31 are arranged parallel to one another and spaced at intervals in the front-to-rear direction in the upper section of the lower casing R. One of the process cartridges 25 is disposed between each neighboring pair of guiding members 31. Each guiding member 31 extends from a vertical center point in the lower casing 8 to the top end thereof.

Each guiding member 31 has the same structure. Accordingly, the structure of one of the guiding members 31 and the positional relationship between the neighboring guiding members 31, 31 will be described in detail.

The guiding member 31 has a front guiding inner surface 32 and a rear guiding inner surface 33 disposed on opposite sides in the front-to-rear direction. The front guiding inner surface 32 has a concave shape in a vertical direction. The rear guiding inner surface 33 has a convex shape in the vertical direction A process cartridge 25 is disposed between a pair of neighboring guiding members 31, 31.

Figure 3:
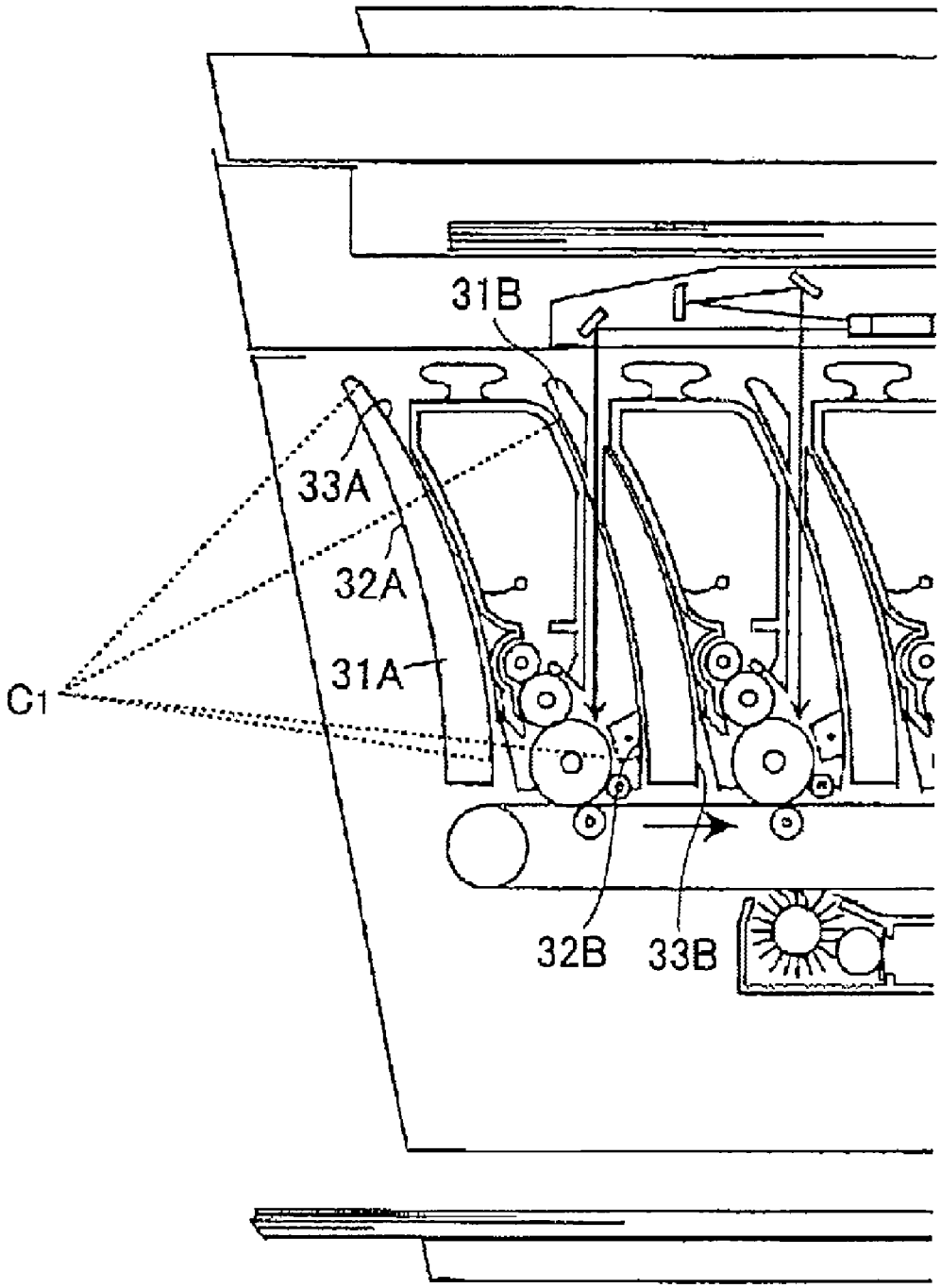
FIG. 3 is an enlarged cross-sectional view of guiding members and a cartridge supported by the guiding members.
Figure 4:
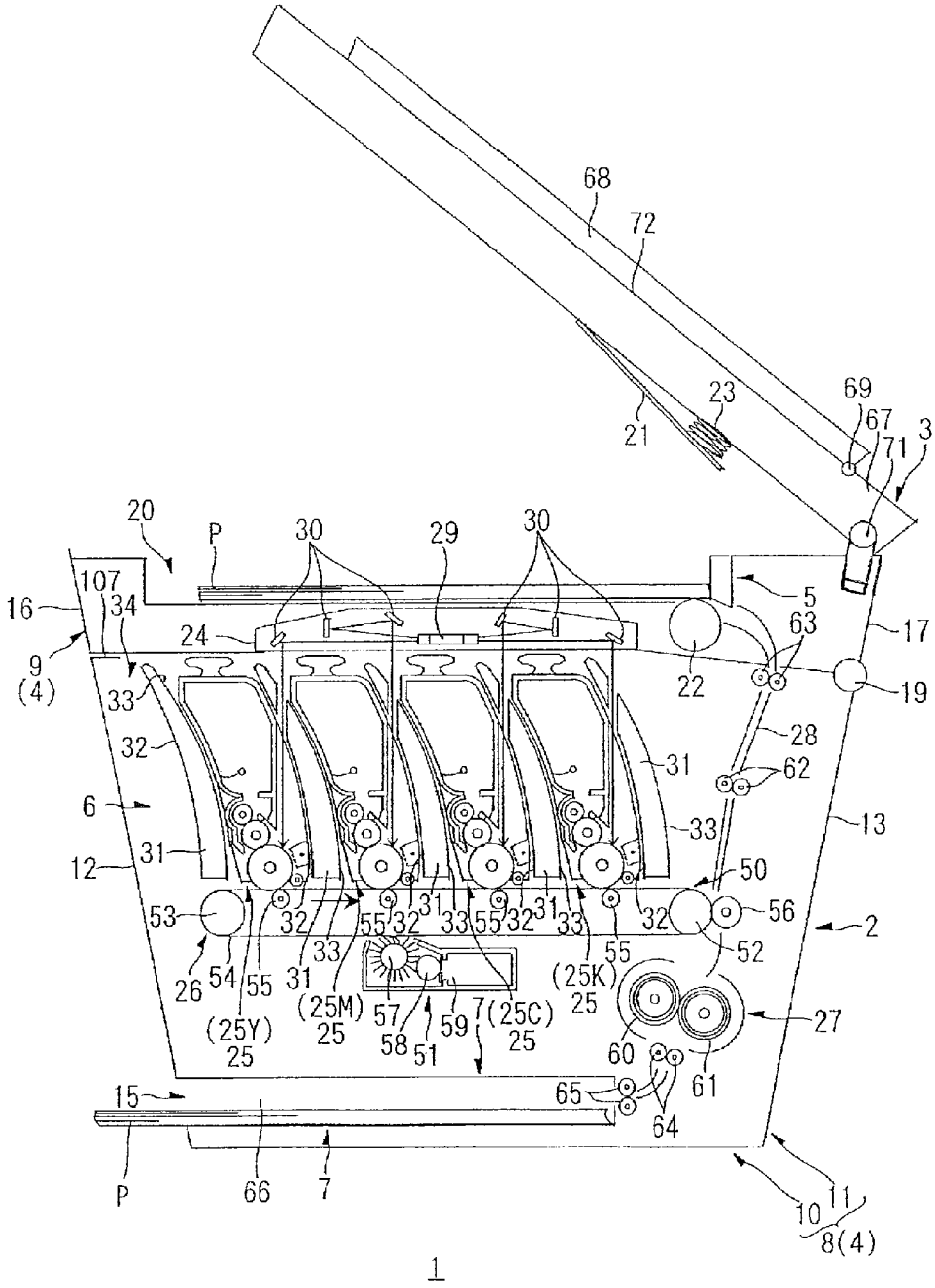
FIG. 4 is a side cross-sectional view showing the multifunction device in FIG. 1, wherein the flatbed scanner is open.

Especially, referring to FIG. 3, the cartridge 25Y is disposed between the guiding member 31A and 31B. The guiding member 31A has a front guiding inner surface 32A and a rear guiding inner surface 33A. The guiding member 31B has a front guiding inner surface 32B facing the rear guiding inner surface 33A by a distance, and a rear guiding inner surface 33B. The pair of neighboring guiding members 31A, 31B are provided so that the rear guiding inner surface 33A and the front guiding inner surface 32B have a vertical cross section forming concentric arcs about a virtual center C1. Thus, the process cartridge 25Y is positioned between the rear guiding inner surface 33A of the forward guiding member 31A and the front guiding inner surface 32B of the rearward guiding member 31B. The process cartridges 25M, 25C, and 25K have the same structural and positional relationship with a corresponding pair of guiding members 31, 31 guiding and supporting the process cartridges 25M, 25C, and 25K, respectively.

As described later, each process cartridge 25 has a casing 36 with a front arcing surface 41 and a rear arcing surface 42. Hence, when the process cartridge 25 is disposed between neighboring guiding members 31, the front arcing surface 41 of the casing 36 opposes and contacts the rear guiding inner surface 33 of the forward guiding member 31, and the rear arcing surface 42 of the casing 36 opposes and contacts the front guiding inner surface 32 of the rearward guiding member 31.

Figure 5:
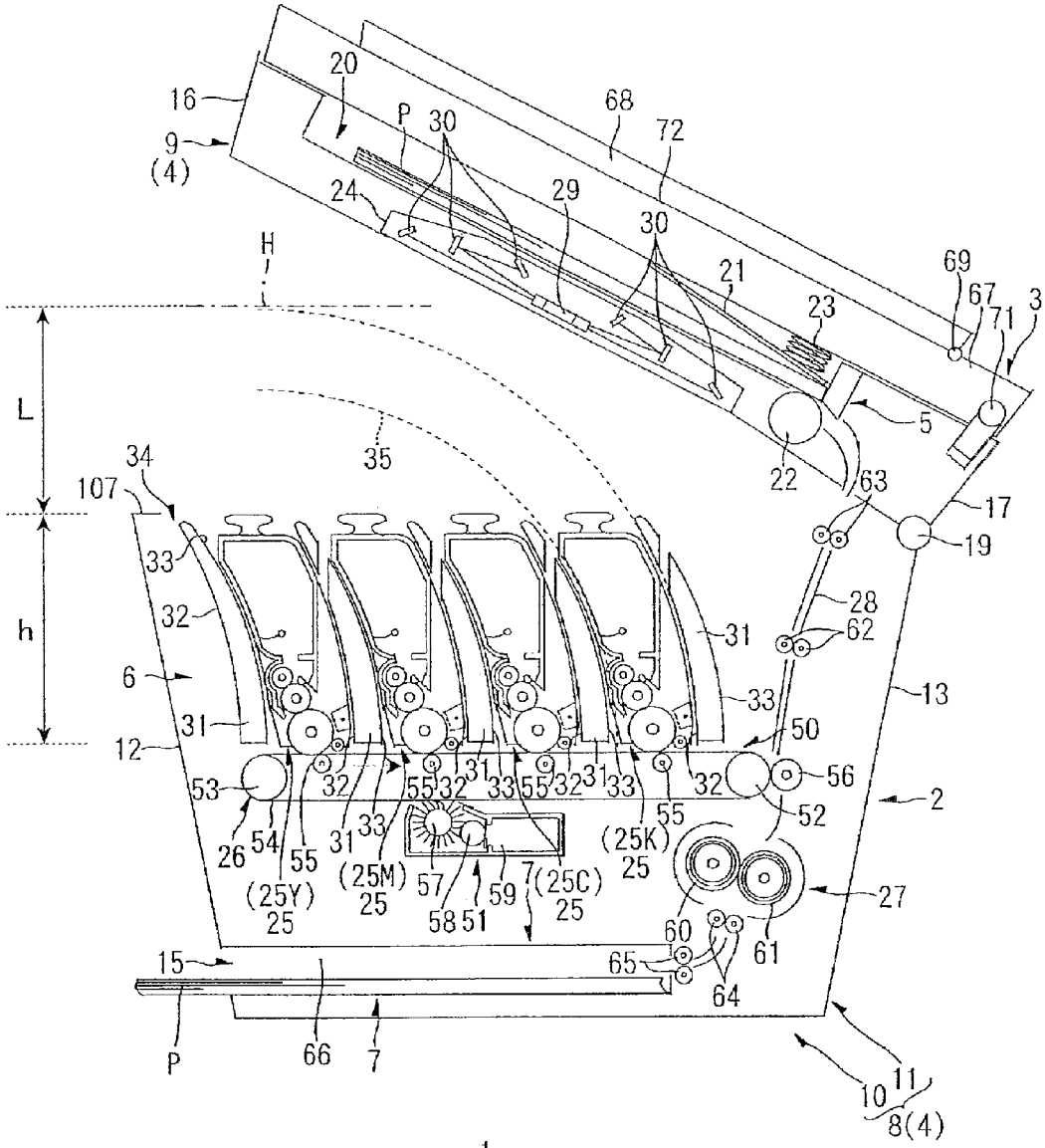
FIG. 5 is a side cross-sectional of the multifunction device in FIG. 1, wherein the flatbed scanner and the upper scanner are open.

As shown in FIG. 5, when the upper casing 9 is opened to the open position, each of the process cartridges 25 is exposed through the access opening 34 formed in the top surface 107 of the lower casing S. When mounting and removing the process cartridges 25, each process cartridge 25 is guided by the guiding members 31 so that the front and rear surfaces of the casing 36 slide against opposing guiding members 31. The process cartridge 25 follows a loading/unloading 35 that passes through the access opening 34 and that is asymptotic to a plane H on the outside of the lower casing 8 parallel to the top surface 107 of the lower casing 9, as indicated by the dotted line in FIG. 5. More specifically, the loading/unloading 35 forms a curved shape (arcing shape in this embodiment) that passes through the access opening 34 and curves toward a horizontal line, that is, a direction along the top surface 107 of the lower casing 8 outside the lower casing 8. When mounting or removing each process cartridge 25, the process cartridge 25 is guided by the guiding members 31 along the loading/unloading 35.

In this embodiment, the plane H lies above the access opening 34 by a distance L. The distance L is shorter than the vertical length "h" of the cartridge 25 mounted in the main casing 4.

Figure 6:
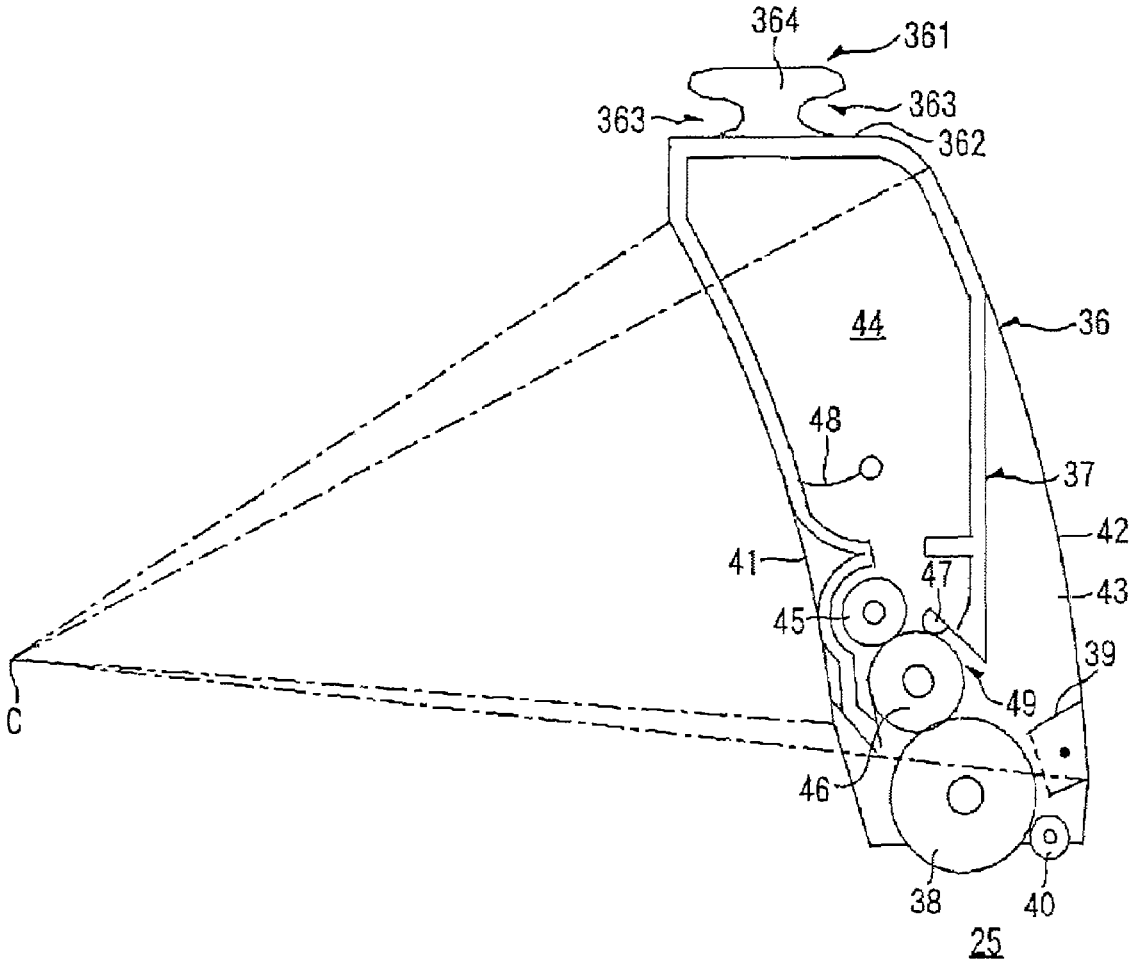
FIG. 6 is a side cross-sectional view of a process cartridge shown in FIG. 2.

As shown in FIG. 6, each process cartridge 25 includes the casing 36, a handle 361 protruding outward from the casing 36, and, within the casing 36, a developer cartridge 37, the photosensitive drum 38, a Scorotron charger 39, and a drum cleaning roller 40.

The following description of the process cartridges 25 is based on a vertical arrangement when the process cartridges 25 are mounted in the lower casing 8.

The casing 36 has a curved exterior shape that follows the loading/unloading 35 (see FIG. 5). Specifically, the casing 36 has a top surface 362, the front arcing surface 41 having an arc-shaped cross section, the rear arcing surface 42 opposing and separated from the front arcing surface 41 in the front-to-rear direction and formed with an arc-shaped cross section that is concentric with the cross-sectional arc of the front arcing surface 41 about a center C2, and side surfaces 43 connecting the front arcing surface 41 and rear arcing surface 42 in a width direction.

In this embodiment, the front arcing surface 41 has the substantially same curvature as that of the rear guiding inner surface 33. The rear arcing surface 42 has the substantially same curvature as that of the front guiding inner surface 32. Accordingly, the cartridge 25 can move between the pair of neighboring guiding members 31, 31 with sliding therebetween.

The handle 361 protrudes upward from the top surface 362 of the casing 36 and extends in the width direction. The handle 361 includes depressed parts 363 formed of curved depressions in the front and rear surfaces of the handle 361, and a grip part 364 formed on the upper end of the handle 36 and having an elliptical cross section that can be gripped by fingers. When mounting (loading) the process cartridge 25 or removing (unloading) the process cartridge 25 from the lower casing 2, the user grips the grip part 364 by inserting fingers into the depressed parts 363. In this way, the user can reliably support the process cartridge 25 as the process cartridge 25 changes orientation during the loading/unloading process, ensuring that the process cartridge 25 moves with stability.

The developer cartridge 37 is mounted in an upper section of the casing 36 and includes a toner-accommodating section 44, a supply roller 45, a developing roller 46, and a thickness-regulating blade 47.

The toner-accommodating section 44 is configured of internal space in the upper section of the developer cartridge 37. An agitator 48 is disposed in the toner-accommodating section 44 for agitating toner accommodated therein.

Each toner-accommodating section 44 is filled with a non-magnetic, single-component toner having a positive charge and of a color corresponding to the respective process cartridge 25. In other words, the toner-accommodating section 44 of the yellow process cartridge 25Y accommodates yellow toner, the toner-accommodating section 44 of the magenta process cartridge 25M accommodates magenta toner, the toner-accommodating section 44 of the cyan process cartridge 25C accommodates cyan toner, and the toner-accommodating section 44 of the black process cartridge 25K accommodates black toner.

The toner used in this embodiment is substantially spherical polymerized toner obtained by copolymerizing a polymerized monomer using a well-known polymerization method, such as suspension polymerization. The polymerized monomer may be, for example, a styrene monomer such as styrene or an acrylic monomer such as acrylic acid, alkyl (C1-C4)acrylate, or alkyl(C1-O4)meta acrylate. This type of toner is compounded with a coloring agent corresponding to the respective color, or wax, as well as an additive such as silica to improve fluidity. The average diameter of the toner particles is about 6-10 μm.

With this construction, the agitator 48 disposed in the toner-accommodating section 44 rotates and agitates the toner accommodated in the toner-accommodating section 44. Some of the agitated toner is discharged through a toner supply opening formed in the lower side of the toner-accommodating section 44 and supplied to the supply roller 45.

The supply roller 45 is rotatably disposed in the developer cartridge 37 below the toner supply opening, and extends in the width direction. The supply roller 45 includes a metal roller shaft covered by an electrically conductive sponge roller.

The developing roller 46 is disposed below the supply roller 45 and extends in the width direction. The toner accommodating section 11 developing roller 46 is capable of rotating while in confrontation with the supply roller 45. The developing roller 46 contacts the supply roller 45 with pressure so that the supply roller 45 is compressed to a degree.

The developing roller 46 is configured of a metal roller shaft covered by an electrically conductive rubber roller. More specifically, the rubber roller of the developing roller 46 has a two-layer structure including a resilient roller formed of an electrically conductive urethane rubber, silicon rubber, or EPDM rubber including fine carbon particles, and a coating covering the surface of the resilient roller and having as the primary component urethane rubber, urethane resin, or polyimide resin. The developing roller 46 is positioned so that a lower portion thereof is exposed through an opening 49 formed in a lower portion of the developer cartridge 37. During a developing operation, a power supply (not shown) applies a developing bias to the developing roller 46.

The thickness-regulating blade 47 is configured of a main blade member formed of a metal leaf spring member, and a pressing part provided on the distal end of the main blade member. The pressing part has a semicircular cross section and is formed of an insulating silicon rubber. A base end of the main blade member is supported on a peripheral edge of the opening 49 formed in the developer cartridge 37 so that the pressing part contacts the surface of the developing roller 46 with pressure through the elastic force of the main blade member.

Toner discharged through the toner supply opening is supplied onto the developing roller 46 by the rotating supply roller 45. As this time, the toner is positively tribocharged between the supply roller 45 and the developing roller 46. As the developing roller 46 rotates, toner carried on the surface of the developing roller 46 passes beneath the pressing part of the thickness-regulating blade 47 so that a thin layer of uniform thickness is carried on the developing roller 46.

The photosensitive drum 38 is disposed below the developing roller 46 and is capable of rotating in the casing 36 while in contact with the developing roller 46. The photosensitive drum 38 is configured of a grounded main drum body, the surface of which is coated with a photosensitive layer formed of an organic material with polycarbonate as the main component. The photosensitive drum 38 is positioned so that a lower portion of the photosensitive drum 38 is exposed through an opening formed in the lower surface of the casing 36.

The charger 39 is mounted on the casing 36 slightly above and rearward of the photosensitive drum 38 and is separated from the photosensitive drum 38 so as not to contact the same. The charger 39 is a positive charging Scorotron charger having a charging wire formed of tungsten from which a corona discharge is generated. The charger 39 charges the entire surface of the photosensitive drum 38 with a uniform positive polarity.

The drum cleaning roller 40 is rotatably disposed in the process cartridge 25 so as to contact the photosensitive drum 38 at a position upstream of the charger 39 with respect to the rotational direction of the photosensitive drum 38. The drum cleaning roller 40 is configured of a metal roller shaft that is covered with an electrically conductive rubber roller. During a cleaning operation, a power supply (not shown) applies a cleaning bias to the drum cleaning roller 40.

With this construction, exposure and development operations for each color of toner are performed by each process cartridge 23 in the following manner. As the photosensitive drum 38 rotates, the charger 39 generates a positive charge over the entire surface of the photosensitive drum 38. Subsequently, the surface of the photosensitive drum 38 is exposed to the scanning of a laser beam emitted from the scanning unit 24, forming an electrostatic latent image on the surface of the photosensitive drum 38 based on prescribed image data. Next, the positively charged toner carried on the surface of the developing roller 46 is brought into contact with the photosensitive drum 38 as the developing roller 46 rotates. At this time, the latent image formed on the surface of the photosensitive drum 36 is developed into a toner image when the toner is selectively attracted to portions of the photosensitive drum 38 that were exposed to the laser beam and, therefore, have a lower potential than the rest of the surface, which has a uniform positive charge. In this way, a toner image is formed through a reverse development process.

As shown in FIGS. 2 through 5, the transfer unit 26 is provided in the lower casing 8 below the process cartridges 25 so as to oppose each of the process cartridges 25 arranged parallel to one another at intervals in the front-to-rear direction. The transfer unit 26 includes an intermediate transfer unit 50, and a belt cleaner unit 51.

The intermediate transfer unit 50 extends in the front-to-rear direction so as to oppose each of the photosensitive drums 38, which are arranged parallel to each other at intervals in the front-to-rear direction. The intermediate transfer unit 50 includes a drive roller 52, a follow roller 53, a transfer belt 54, primary transfer rollers 55, and a secondary transfer roller 56. The drive roller 52 is disposed rearward of the photosensitive drum 38 in the rearmost black process cartridge 25K. The follow roller 53 is disposed forward of the photosensitive drum 38 in the forwardmost yellow process cartridge 25Y.

The transfer belt 54 is formed of an electrically conductive polycarbonate, or polyimide diffused with electrically conductive carbon particles. The transfer belt 54 is looped around the drive roller 52 and follow roller 53 so that an outer surface on the top side contacts all of the photosensitive drums 38 in the process cartridges 25.

When the drive roller 52 is driven to rotate, the follow roller 53 follows this rotation as the transfer belt 54 circulates around the drive roller 52 and follow roller 53. Accordingly, the outer surface of the transfer belt 54 on the top side contacting the photosensitive drums 38 moves in the same direction as the surfaces of the photosensitive drums 38 at the contact points.

The primary transfer rollers 55 are disposed inside the transfer belt 54 at positions opposing the photosensitive drums 38 so as to pinch the transfer belt 54 therebetween. Each primary transfer rollers 55 is configured of a metal roller shaft that is covered with an electrically conductive rubber roller. The primary transfer rollers 55 are disposed in contact with the inner surface of the transfer belt 54 on the upper side and rotate in a direction conforming to the circular movement of the transfer belt 54 at the points of contact with the transfer belt 54. During a transfer operation, a power supply (not shown) applies a primary transfer bias to the primary transfer rollers 55.

The secondary transfer roller 56 is disposed outside the transfer belt 54 at a position rearward and opposing the drive roller 52 so as to pinch the transfer belt 54 therebetween. The secondary transfer roller 56 is configured of a metal roller shaft that is covered with an electrically conductive rubber roller. The secondary transfer roller 56 is disposed in contact with the outer surface of the transfer belt 54 on the rear side thereof and rotates in a direction conforming to the circular movement of the transfer belt 54 at points of contact with the same. During a transfer operation, a Dower supply (not shown) applies a secondary transfer bias to the secondary transfer roller 56.

The belt cleaner unit 51 is disposed on the opposite side (lower side) of the looped transfer belt 54 from the photosensitive drums 38 and is positioned between the drive roller 52 and follow roller 53. The belt cleaner unit 51 includes a cleaning brush 57, a recovery roller 58, and a recovery box 59.

The cleaning brush 57 is configured of a metal brush shaft, and an electrically conductive brush member provided around the brush shaft. The cleaning brush 57 is disposed in contact with the outer surface of the transfer belt 54 on the bottom side thereof. The cleaning brush 57 is rotatably disposed in the belt cleaner unit 51 so as to rotate in a direction that conforms to the circular movement of the transfer belt 54 at the point of contact. During a cleaning operation, a power supply (not shown) applies a primary cleaning bias to the cleaning brush 57.

The recovery roller 58 is configured of a metal roller shaft that is covered by an electrically conductive rubber material. The recovery roller 58 is disposed rearward of the cleaning brush 57 and in contact with the same, and is rotatably disposed in the belt cleaner unit 51. During a cleaning operation, a power supply (not shown) applies a secondary cleaning bias to the recovery roller 58.

The recovery box 59 is disposed rearward of the recovery roller 58 and is open on the side opposing the recovery roller 58. A scraper is disposed near the open portion of the recovery box 59 and contacts the surface of the recovery roller 58 with pressure.

The fixing unit 27 is disposed in the lower casing 8 below a secondary transfer position between the drive roller 52 and the secondary transfer roller 56 of the intermediate transfer unit 50. The fixing unit 27 includes a primary heating roller 60 and a secondary heating roller 61.

The primary heating roller 60 is rotatably supported in the lower casino 8 and is configured of a metal tube formed of aluminum, and a halogen lamp disposed inside the metal tube. The outer surface of the metal tube is treated to prevent toner from depositing thereon.

The secondary heating roller 61 is positioned on the rear side of the primary heating roller 60 and in confrontation with the same so as to pinch the paper 2 in the front-to-rear direction as the paper P passes through the fixing unit 27. The secondary heating roller 61 is also configured of a metal tube formed of aluminum, and a halogen lamp disposed inside the metal tube. The secondary heating roller 61 is rotatably supported in the lower casing 8 so as to contact the primary heating roller 60 with pressure.

The conveying path 28 is formed in the lower casing 8 for conveying the paper P. The conveying path 28 runs from the paper supply unit 5 downward along the rear side of the rearmost black process cartridge 25K, passes between the primary heating roller 60 and secondary heating roller 61 of the fixing unit 27 and ends at the discharge unit 7.

A pair of registration rollers 62 are provided along the conveying path 28 between the paper supply unit S and the secondary transfer position. A pair of conveying rollers 63 are disposed on the conveying path 28 between the registration rollers 62 and the paper supply unit 5. A pair of conveying rollers 64 are provided along the conveying path 28 between the fixing unit 27 and the discharge unit 7.

The paper P supplied from the paper supply unit 5 is conveyed along the conveying path 28 in a downward direction. After the registration rollers 62 register the paper P, the paper P is conveyed to the secondary transfer position.

In the meantime in the transfer unit 26, the drive roller 52 is driven, and the transfer belt 54 moves in a circular path as the follow roller 53 follows. Toner images in each color formed on each photosensitive drum 38 are sequentially transferred onto the circularly moving transfer belt 54 as the transfer belt 54 passes through primary transfer positions between the photosensitive drums 38 and the corresponding primary transfer rollers 55 opposing the photosensitive drums 38. In this way, a color image is formed on the transfer belt 54.

For example, first a yellow toner image formed on the photosensitive drum 38 of the yellow process cartridge 25Y is transferred onto the transfer belt 54. Next, a magenta toner image formed on the photosensitive drum 38 of the magenta process cartridge 25M is transferred onto the transfer belt 54 and superimposed over the previously transferred yellow toner image. In the same way, a cyan toner image and a black toner image formed in the cyan process cartridge 25C and black process cartridge 25K, respectively, are transferred onto the transfer belt 54 and superimposed over the previously transferred images, thereby completing a color image.

The color image formed on the transfer belt 54 is subsequently transferred all at once onto the paper E when the paper P, having been registered and conveyed toward the secondary transfer position, passes between the drive roller 52 and the secondary transfer roller 56.

After a color image has been formed on the paper P, the paper P is conveyed to the fixing unit 27, where the primary heating roller 60 and secondary heating roller 61 fix the color image to the paper P by heat as the paper P passes between the primary heating roller 60 and secondary heating roller 61. After the fixing process, the conveying rollers 64 convey the paper P into the discharge unit 7. This process achieves the printer function of the multifunction device 1.

After toner images in each color have been transferred onto the paper P, toner remaining on the surface of the photosensitive drum 38 is temporarily captured by the drum cleaning roller 40. When an image-forming operation is not being performed, the front arcing surface 41 returns the toner to the photosensitive drum 38, and the developing roller 46 collects the toner to be reused for image development.

Further, after a color image has been transferred onto the paper P, paper dust deposited on the surface of the transfer belt 54 from the paper P during the secondary transfer is attracted to the cleaning brush 57 when the toner opposes the cleaning brush 57 due to the primary cleaning bias applied to the cleaning brush 57. Subsequently, the toner attracted to the cleaning brush 57 is deposited on the recovery roller 58 when the toner confronts the recovery roller 58 due to the secondary cleaning bias applied to the recovery roller 58. Next, the scraper scrapes the toner from the recovery roller 58, and the toner is collected in the recovery box 59.

The discharge unit 7 is disposed in the lowermost section of the lower casing 8. Hence, the process cartridge 25, transfer unit 26, fixing unit 27, and discharge unit 7 are arranged in order from top to bottom an the lower section of the lower casing 8. Further, the paper supply unit 5, engine unit 6, and discharge unit 7 are arranged in order from top to bottom in the main casing 4 In the overall multifunction device 1, the flatbed scanner 3, paper supply unit 5, and engine unit 6, and discharge unit 7 are arranged in order from top to bottom.

The discharge unit 7 includes a pair of discharge rollers 65, and a discharge holder 66.

The discharge rollers 65 are disposed below the fixing unit 27 on the downstream end of the conveying path 28. After a color image has been fixed to the paper P with heat in the fixing unit 27, the discharge rollers 65 discharge the paper P onto the discharge holder 66.

The discharge holder 66 is disposed in the lower section of the lower casing 8 and is configured of a partitioned space extending in the front to rear direction for accommodating the discharged paper P. The length of the discharge holder 66 in the front-to-rear direction is shorter than the length of the largest paper 2 that can be accommodated in the paper-accommodating depression 20 (such as an A4-size paper P) in the conveying direction. The discharge holder 66 is in communication with the paper discharge opening 15 formed in the lower region of the front surface 12. The discharge holder 66 is also deep enough to accommodate a plurality of sheets of discharged paper P stacked vertically.

With this construction, the discharge rollers 65 discharge the paper P in a forward direction into the discharge holder 66 so that the leading edge of the paper P protrudes from the paper discharge opening 15. The discharged paper P is maintained in the discharge holder 66 in a vertically stacked state.

The flatbed scanner 3 includes a main scanner body 67, and an original restraining cover 68 that is rotatably supported on the main scanner body 67.

The main scanner body 67 is formed at the same size as the printer 2 in a plan view. The side surfaces of the main scanner body 67 slope outward from the upward edge of the upper casing 9 on the printer 2 so as to appear integrally formed with the printer 2. The top surface of the main scanner body 67 extends horizontally and serves as an original support surface 72 for placing an original document. A glass plate (not shown) is fitted into the original support surface 72. While not shown in the drawings, the main scanner body 67 internally accommodates a CCD sensor disposed below the glass plate for reading image data from the original, a scanning motor for scanning the CCD sensor horizontally (in the front-to-rear direction) while the CCD sensor opposes the glass plate, and the like.

A rotational shaft 71 is inserted through a lower edge on the rear surface on the main scanner body 67 and extends in the width direction along the top edge of the rear surface 17 on the upper casing 9. The main scanner body 67 is rotatably supported by the rotational shaft 71. With this construction, the main scanner body 67 is capable of rotating between a closed position (the position shown in FIG. 2) in which the bottom surface of the main scanner body 67 contacts the top edges of the upper casing 9 and corners the top surface of the upper casing 9, and an open position (the position shown in FIG. 4) in which the front edge of the main scanner body 67 is raised. When the main scanner body 67 is rotated to the open position, the paper-accommodating depression 20 is exposed through the top surface of the upper casing 9, enabling a user to load the paper P in the paper-accommodating depression 20. When the main scanner body 67 is rotated to the closed position, the main scanner body 67 covers the Cop of the paper-accommodating depression 20

The original restraining cover 68 is a thin plate having a rectangular shape in a plan view. The original restraining cover 68 can cover the entire surface of the glass plate fitted into the top surface (the original support surface 72) of the main scanner body 67. The original restraining cover 68 is rotatably supported on a shaft 69 extending parallel to the rotational shaft 71 on the rear edge of the main scanner body 67. Hence, the original restraining cover 68 can rotate to expose the original support surface 72 or cover the original support surface 72. Specifically, the original support surface 72 is exposed when the front edge of the original restraining cover 68 is lifted upward, as indicated by the dotted line in FIG. 2, and the glass plate fitted into the original support surface 72 is covered when the front edge of the original restraining cover 68 is rotated downward, as indicated by the solid line in FIG. 2. When the original restraining cover 68 is closed while an original document rests on the glass plate, the original restraining cover 68 can press the original against the glass plate.

In the flatbed scanner 3 described above, after an original document has been placed on the original support surface 72 and a personal computer (not shown) connected to the multifunction device 1 inputs a Read Start signal into the multifunction device 1, the CCD sensor reads an image from the original and acquires image data. This configuration achieves the scanner function of the multifunction device 1. Image data acquired by the CCD sensor is then transmitted to the personal computer.

Based on a command from the personal computer, the image data acquired by the CCD sensor can be transmitted to the printer 2 so that the printer 2 can form a color image on the paper 2 based on this image data. This process achieves the copier function of the multifunction device 1.

In the first embodiment described above, when the upper casing 9 is in the open position, the process cartridge 25 can be mounted in or removed from the lower casing 8 through the access opening 34 formed in the top surface 107 of the lower casing 8. The process cartridges 25 are mounted and removed along the loading/unloading 35 that is asymptotic to the plane H parallel to the top surface 107 on the outer side of the lower casing 8 so that the developing roller 46 provided in the process cartridges 25 are parallel to each other at any position on the loading/unloading 35. Accordingly, the process cartridges 25 can be mounted in or removed from the lower casing 8 by allocating space between the lower casing 8 and the upper casing 9 in the open position that is slightly wider than the width between the front arcing surface 41 and the rear arcing surface 42 of the casing 36. Hence, it is possible to reduce the space that the multifunction device 1 occupies, and to increase the flexibility in choosing an installation location for the multifunction device 1.

Further, since the loading/unloading 35 forms a curved shape (arcing shape) outside the lower casing 8, the process cartridges 25 can be smoothly mounted in or removed from the lower casing 8. Accordingly, it is possible to ensure smooth mounting and removal of the process cartridges 25, and to increase the flexibility in choosing an installation location for the multifunction device 1.

Further, the casing 36 of the process cartridge 25 is Formed in an arc shape that conforms to the curve of the loading/unloading 35, wherein the casing 36 has the front arcing surface 41 that opposes and contacts the rear guiding inner surface 33 of a forward guiding member 31, and the rear arcing surface 42 that opposes and contacts the front guiding inner surface 32 of a rearward guiding member 31. Hence, the width in the curved portion of the loading/unloading 35 can be substantially equivalent to the distance between the front arcing surface 41 and rear arcing surface 42 of the casing 36. As a result, it is possible to reduce the size of the lower casing 8 (the main casing 4) and to reduce the space required between the lower casing 8 and the upper casing 9 in the open position. Hence, it is possible to further reduce the space occupied by the multifunction device 1, and to further increase the flexibility in choosing an installation location.

By forming the casing 36 in a shape conforming to the loading/unloading 35, it is possible to smoothly mount the casing 36 into and remove the casing 36 from the lower casing 8, even when the casing 36 is formed of a size large enough to contact members disposed on the periphery of the loading/unloading 35. Hence, it is possible to increase the size of the casing 36 in order to increase the amount of toner that can be accommodated therein, for example.

Moreover, the process cartridge 25 is guided into and out of the lower casing 8 by the casing 36 sliding against the guiding members 31. Hence, with a simple construction of providing the guiding members 31 in the lower casing 8, it is possible to smoothly and reliably guide the process cartridges 25 in the mounting and removing process.

Further, by providing the handle 361 on the casing 36 of each process cartridge 25, the user can mount and remove the process cartridge 25 with respect to the lower casing 8 by gripping the depressed parts 363 formed in the handle 361. When the process cartridge 25 is mounted in the lower casing 8, the user can easily pull the process cartridge 25 from the lower casing 8 by gripping the grip part 364 of the handle 361 on the outside end of the depressed parts 363. Further, when the process cartridge 25 is positioned on the loading/unloading outside of the lower casing 8, the front arcing surface 41 and rear arcing surface 42 of the casing 36 oppose each other vertically. In this state, the user can reliably support the process cartridge 25 with fingers inserted into the depressed part 363 positioned on the lower side. Accordingly, this construction can improve operability in mounting the process cartridge 25 into and removing the process cartridge 25 from the lower casing 8.

Since the access opening 34 is former in the top surface 107 of the lower casing 8 in the multifunction device 1 of the first embodiment, the user can access the lower casing 8 from above in order to mount and remove the process cartridges 25. Accordingly, this construction further improves operability.

Moreover, the upper casing 9 that opens and closes over the access opening 34 is rotatably provided about the rotational shaft 19 disposed on the rear surface side of the access opening 34. Accordingly, the user can open and close the upper casing 9 from the front surface side of the multifunction device 1. Further, when removing the process cartridges 25 from the lower casing 8, the process cartridge 25 can be pulled toward the front surface side of the multifunction device 1, thereby further improving operability.

Further, since the rotational shaft 19 of the upper casing 9 is disposed on the convex side of the loading/unloading 35, it is possible to prevent the upper casing 9 from interfering with the loading/unloading 35 when the upper casing 9 is opened. With this construction, it is unnecessary to open the upper casing 9 widely when mounting and removing the process cartridges 25, thereby reducing the space occupied by the multifunction device 1 and making it possible to increase the flexibility in choosing an installation location.

Since it is possible to reduce the space required for mounting and removing process cartridges 25 that are frequently exchanged to the multifunction device 1, the amount of space occupied by the multifunction device 1 can be effectively reduced.

Further, a plurality of the process cartridges 25 may be disposed parallel to one another and spaced in the front-to-rear direction in what is called a tandem layout, while allowing neighboring process cartridges 25 to be mounted in the lower casing 8 and removed from the lower casing 8 without interfering with each other. Hence, this construction can reduce the amount of space occupied by the multifunction device 1 and can increase the flexibility in choosing an installation location.

The multifunction device 1 of the first embodiment described above can increase flexibility in choosing an installation location, even when provided with the flatbed scanner 3.

The next description will be made for explaining a second embodiment of the invention, referring to FIGS. 7 and 8.

Figure 7:
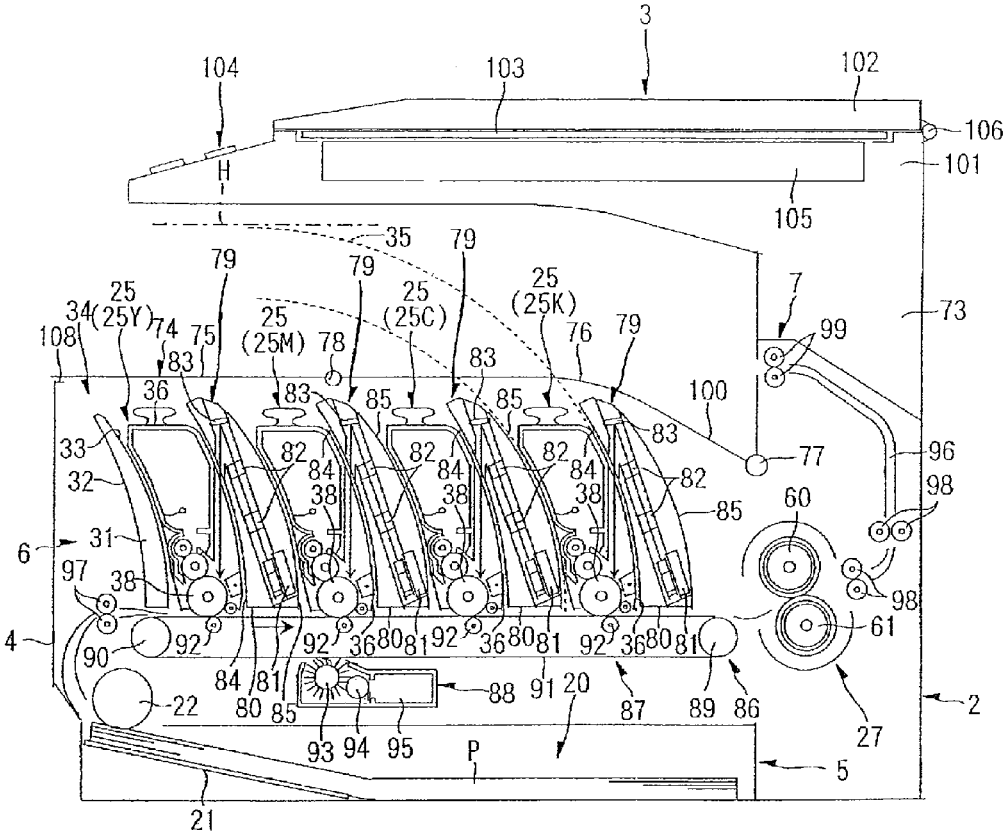
FIG. 7 is a side cross-sectional view of a multifunction device according to a second embodiment of the present invention, wherein a top cover is closed.
Figure 8:
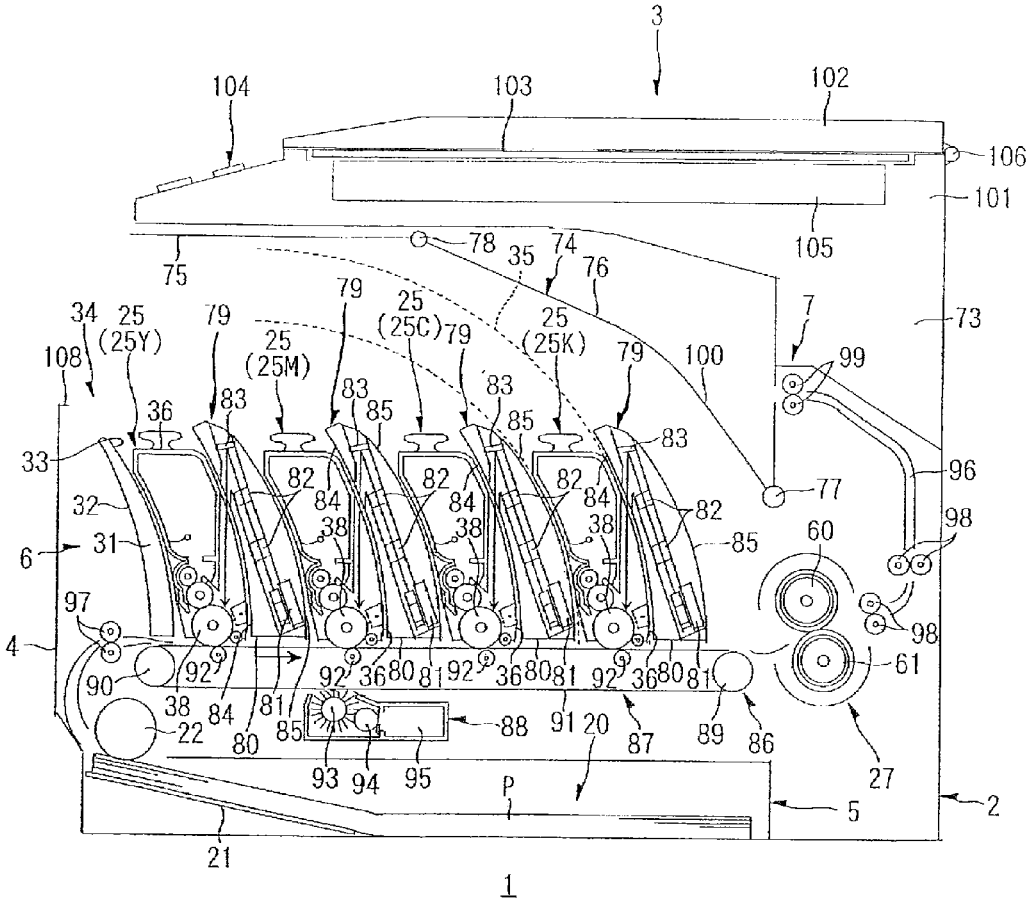
FIG. 8 is a side cross-sectional view of the multifunction device in FIG. 7, wherein the top cover is open.

In FIGS. 7 and 8, like parts and components to those described in the first embodiment have been designated with the same reference numerals to avoid duplicating description. In the second embodiment, only aspects differing from the first embodiment will be described below, while a description of similar aspects have been omitted.

In the multifunction device 1 according to the second embodiment, the flatbed scanner 3 is provided with a suitable space formed over the printer 2. More specifically, a support part 73 extends upward from the rear end of the printer 2, and the flatbed scanner 3 extends horizontally forward from the upper end of the support part 73.

The printer 2 is a direct tandem color laser printer including the main casing 4 and, within the main casing 4, the paper supply unit 5, engine unit 6, and discharge unit 7.

The main casing 4 is formed of a hard synthetic resin in a box shape that is rectangular in a plan view.

The access opening 34 is formed in a top surface 108 of the main casing 4 for allowing the mounting and removing of the process cartridges 25. A top cover 74 is disposed over the access opening 34 for opening and closing the access opening 34.

The top cover 74 is divided into a front division member 75 for covering the access opening 34 from the front edge to a midpoint thereof in the front-to-rear direction, and a rear division member 76 for covering the access opening 34 from the midpoint in the front-to-rear direction to the rear edge of the access opening 34. When the access opening 34 is covered, the rear division member 76 extends horizontally in the front half, and slopes downward in the rear half. The rear end of the rear division member 76 is rotatably supported on a shaft 77 extending horizontally along the rear edge of the access opening 34. The front division member 75 and rear division member 76 are rotatably coupled by a coupling shaft 78. With this construction, when the front end of the front division member 75 is raised, the rear division member 76 extends diagonally upward toward the front, while the front division member 75 extends horizontally forward from the front edge of the rear division member 76.

In the second embodiment, the paper supply unit 5 is exposed in the lower section of the main casing 4. In the paper supply unit 5, the paper-accommodating depression 20 is formed as a cassette having a frame member with a bottom surface. The paper-accommodating depression 20 is detachably mounted in the main casing 4 in a front-to-rear direction through the front surface of the printer 2. Further, the paper-pressing plate 21 is disposed from a front-to-rear midpoint of the paper-accommodating depression 20 to the front edge thereof A compression spring (not shown) is disposed on the underside surface of the paper-pressing plate 21 for urging the front end of the paper-pressing plate 21 upward. The feeding roller 22 is disposed above the front end of the paper-accommodating depression 20 so as to oppose the front end of the paper-pressing plate 21 urged upward by the compression spring.

In the paper supply unit 5, the paper P is loaded on the paper-pressing plate 21 in the paper-accommodating depression 20 so as to extend in the front-to-rear direction. The topmost sheet of the paper P stacked on the paper-pressing plate 21 is pressed against the feeding roller 22 by the paper-pressing plate 21. The rotating feeding roller 22 supplies the topmost sheet of paper P toward the engine unit 6.

The engine unit 6 includes the process cartridges 25, scanning units 79, a transfer unit 86, the fixing unit 27, and a conveying path 96.

In the second embodiment, the process cartridges 25 are provided for each of four colors of toner. The process cartridges 25 are disposed parallel to one another and arranged in the front-to-rear direction in the top section of the main casing 4. More specifically, the process cartridges 25 include a yellow process cartridge 25Y, magenta process cartridge 25M, cyan process cartridge 25C, and black process cartridge 25K that are disposed at prescribed intervals from front to rear in the order given.

The process cartridges 25 have the same structure as those of the first embodiment.

In the second embodiment, four of the scanning units 79 are provided to correspond to the number of process cartridges 25. Each scanning unit 79 is disposed on the rear side of the corresponding process cartridge 25. Hence, the process cartridges 25 and scanning units 79 are alternately arranged in the front-to-rear direction in the top section of the main casing 4.

Each scanning unit 79 includes a unit casing 80 and, within the unit casing 80, a polygon mirror 81 that can be driven to rotate, two lenses 82, and a reflecting mirror 83. As indicated by arrows in the drawing, a laser light-emitting unit (not shown) of each scanning unit 79 emits a laser beam based on prescribed image data that sequentially passes through or is reflected by the polygon mirror 81, the two lenses 82, and the reflecting mirror 83 before being irradiated in a high-speed scanning motion onto the surface of the photosensitive drum 38, The unit casing 80 includes a front guide surface 84, and a rear guide surface 35 that oppose each other in the front-to-rear direction. The front guide surface 84 and rear guide surface 85 have cross-sectional shapes formed as concentric arcs with the convex side facing the rear In the case of two adjacent scanning units 79, a process cartridge 25 is disposed between the rear guide surface 85 of the forward scanning unit 79 and the front guide surface 84 of the rearward scanning unit 79. In this state, the front arcing surface 41 of the casing 36 on the process cartridge 25 opposes and contacts the rear guide surface 85 of the forward scanning unit 79, while the rear arcing surface 42 of the casing 36 opposes and contacts the front guide surface 84 of the rearward scanning unit 79. A single guiding member 31 is disposed on the front of the yellow process cartridge 25Y so that the yellow process cartridge 25Y is disposed between the guiding member 31 and one of the scanning units 79. Hence, the front arcing surface 41 of the casing 36 on the yellow process cartridge 25Y opposes and contacts the rear guiding inner surface 33 of the guiding member 31, while the rear arcing surface 42 of the casing 36 opposes and contacts the front guide surface 84 of the scanning unit 79.

With this construction, when the top cover 74 is in the open state shown in FIG. 8, each process cartridge 25 can be mounted in and removed from the lower casing 8 through the access opening 34 and along the loading/unloading 35 indicated by the dotted lines. The loading/unloading 35 is curved in an arc shape that leads to a horizontal direction between the main casing 4 and the flatbed scanner 3. The process cartridges 25 are mounted and removed by sliding the casing 36 along the unit casings 80 of the scanning units 79 Hence, the unit casing 80 in the scanning unit 79 serves also as guiding means in the second embodiments The transfer unit 86 is disposed in the main casing 4 below the process cartridges 25 and extends in the front-to-rear direction so as to oppose each of the process cartridges 25 juxtaposed in a parallel relationship. The transfer unit 86 includes a transfer belt unit 87, and a belt cleaner unit 88.

The transfer belt unit 87 extends horizontally so as to oppose each of the photosensitive drums 38 that are arranged parallel to each other and juxtaposed horizontally. The transfer belt unit 87 includes a drive roller 89, a follow roller 90, a conveying belt 91, and transfer rollers 92.

The drive roller 89 is disposed rearward of the photosensitive drum 38 in the rearmost black process cartridge 25K. The follow roller 90 is disposed forward of the photosensitive drum 38 in the frontmost yellow process cartridge 25Y.

The conveying belt 91 is formed of an electrically conductive polycarbonate, or polyimide diffused with electrically conductive carbon particles. The conveying belt 91 is looped around the drive roller 89 and the follow roller 90 so that the outer surface of the conveying belt 91 on the forward facing side contacts all of the photosensitive drums 36 in the process cartridges 25.

When the drive roller 89 is driven to rotate, the follow roller 90 follows this rotation as the conveying belt 91 circulates around the drive roller 89 and the follow roller 90. Accordingly, the outer surface of the conveying belt 91 on the top side contacting the photosensitive drums 38 moves in the same direction as the surfaces of the photosensitive drums 38 at the contact points.

The transfer rollers 92 are disposed inside the conveying belt 91 at positions opposing the photosensitive drums 38 so as to pinch the conveying belt 91 therebetween. Each transfer roller 92 is configured of a metal roller shaft that is covered with an electrically conductive rubber roller. The transfer rollers 92 are disposed in contact with the inner surface of the conveying belt 91 on the lower side thereof and rotate in a direction conforming to the circular movement of the conveying belt 91. During a transfer operation, a power supply (not shown) applies a transfer bias to the transfer rollers 92.

The belt cleaner unit 88 is disposed on the opposite side (bottom side) of the conveying belt 91 from the photosensitive drums 38 and is positioned between the drive roller 89 and the follow roller 90. The belt cleaner unit 88 includes a cleaning brush 93, a recovery roller 94, and a recovery box 95.

The cleaning brush 93 is configured of a metal roller shaft that is covered with an electrically conductive brush member. The cleaning brush 93 is disposed in contact with the outer surface of the conveying belt 91 on the bottom side thereof and is rotatably disposed in the belt cleaner unit 88 so as to rotate in a direction that conforms to the circular movement of the conveying belt 91 on the bottom side. During a cleaning operation, a power supply (not shown) applies a primary cleaning bias to the cleaning brush 93.

The recovery roller 94 is configured of a metal roller shaft that is covered by an electrically conductive rubber roller. The recovery roller 94 is disposed rearward of the cleaning brush 93 and in contact with the same, and is rotatably disposed in the belt cleaner unit 82. During a cleaning operation, a power supply (not shown) applies a secondary cleaning bias to the recovery roller 94.

The recovery box 95 is disposed on the rear side of the recovery roller 94 and is open on a side opposing the recovery roller 94. A scraper is disposed near the open portion of the recovery box 95 and contacts the surface of the recovery roller 94 with pressure.

The fixing unit 27 is disposed in the main casing 4 to the rear of the transfer unit 86.

The conveying path 96 is formed in the main casing 4 from the front end of the paper supply unit 5. The conveying path 96 begins with the front end of the paper supply unit 5 so as to pass between the photosensitive drums 38 of the process cartridge 25 and the conveying belt 91 in a rearward direction and to subsequently pass between the primary heating roller 60 and secondary heating roller 61 of the fixing unit 27. The conveying path 96 then makes a U-turn toward a direction upward and forward to convey the paper P to the discharge unit 7.

A pair of registration rollers 97 are provided along the conveying path 96 between the paper supply unit 5 and the conveying belt 91. A plurality of pairs of conveying rollers 98 are provided between the fixing unit 27 and the discharge unit 7.

With the above construction, the paper supply unit 5 feeds the paper P onto the conveying path 96. The driving of the drive roller 89 moves the conveying belt 91 circularly as the follow roller 90 follows, and the conveying belt 91 conveys the paper P along the conveying path 96. Hence, the paper P is sequentially conveyed through transfer positions between the conveying belt 91 and each of the photosensitive drums 38, at which toner images formed on the photosensitive drums 38 are sequentially transferred onto the paper P, forming a color image thereon.

For example, first a yellow toner image formed on the photosensitive drum 38 in the yellow process cartridge 25Y is transferred onto the paper P. Next, a magenta toner image formed on the photosensitive drum 38 in the magenta process cartridge 25M is transferred onto the paper P and superimposed over the previously transferred yellow toner image. In the same way, a cyan toner image and a black toner image formed in the cyan process cartridge 25C and black process cartridge 25K, respectively, are transferred onto the paper P and superimposed over the previously transferred images, thereby completing a color image.

Once a color image has been formed on the paper P, the paper P is conveyed to the fixing unit 27. The primary heating roller 60 and secondary heating roller 61 of the fixing unit 27 fix the color image to the paper P with heat as the paper P passes therebetween. After passing through the fixing unit 27, the conveying rollers 98 convey the paper P toward the discharge unit 7, thereby achieving the printer function of the multifunction device 1.

The discharge unit 7 includes a pair of discharge rollers 99, and a discharge tray 100.

The discharge rollers 99 are disposed above the fixing unit 27 and or the downstream end of the conveying path 96. The discharge rollers 99 discharge the paper P onto the discharge tray 100 after a color image has been fixed on the paper P in the fixing unit 27.

The discharge tray 100 is formed on the top surface of the top cover 74.

Hence, the discharge rollers 99 receive the paper P conveyed along the conveying path 96 and discharge the paper P in a forward direction onto the discharge tray 100.

The flatbed scanner 3 includes a main scanner body 101, and an original restraining cover 102 that is rotatably supported on the main scanner body 101.

A glass plate 103 is fitted into the top surface of the main scanner body 101. The top surface of the glass plate 103 serves as an original support surface for supporting an original document. The top surface of the main scanner body 101 includes a sloped surface on a front end of the main scanner body 101. In other words, a front portion in front of the glass plate 103 slopes downward. A control panel 104 is provided on this sloped front portion. The control panel 104 includes a liquid crystal panel for displaying the operation state of the multifunction device 1, and buttons that the user can operate to set various conditions.

The main scanner body 101 includes a reading mechanism 105 disposed below the glass plate 103. The reading mechanism 105 accommodates a CCD sensor for reading image data from the original, a scanning motor for scanning the CCD sensor horizontally (in the front-to-rear direction) while the CCD sensor opposes the glass plate 103.

The original restraining cover 102 is a thin plate having a rectangular shape in a plan view. The original restraining cover 102 can cover the entire surface of the glass plate 103 fitted into the top surface of the main scanner body 101. The original restraining cover 102 is rotatably supported on the rear edge of the main scanner body 101 by hinges 106. Hence, the glass plate 103 in the main scanner body 101 is exposed when the front edge of the original restraining cover 102 is lifted upward and is covered when the front edge of the original restraining cover 102 is rotated downward. When the original restraining cover 102 is closed while an original document rests on the glass plate 103, the original restraining cover 102 can press the original against the glass plate 103.

In the flatbed scanner 3 described above, after an original document has been placed on the glass plate 103 and the user operates the control panel 104 or a personal computer (not shown) connected to the multifunction device 1 inputs a Read Start signal into the multifunction device 1, the CCD sensor reads an image from the original and acquires image data. This configuration achieves the scanner function of the multifunction device 1. Image data acquired by the CCD sensor is transmitted to the personal computer.

Based on a command from the personal computer, the image data acquired by the COD sensor can be transmitted to the printer 2 so that the printer 2 can form a color image on the paper P based on this image data. This process achieves the copier function of the multifunction device 1.

In the multifunction device 1 according to the second embodiment described above, when the top cover 74 is in the open position, the process cartridges 25 can be mounted in or removed from the main casing 4 through the access opening 34 formed in the top surface 108 of the main casing 4. The process cartridges 25 are mounted and removed along the loading/unloading 35 arcing toward a horizontal direction outside of the lower casing 8. Accordingly, the process cartridges 25 can be reliably mounted in or removed from the main casing 4 through the access opening 34 by disposing the flatbed scanner 3 above the printer 2, without needing to allocate a large space between the printer 2 and the flatbed scanner 3.

While the invention has been described in detail with reference to specific embodiments thereof, it would be apparent to those skilled in the art that many modifications and variations may be made therein without departing from the spirit of the invention, the scope of which is defined by the attached claims. For example, while the loading/unloading 35 curves in an arc shape in these embodiments described above, the loading/unloading 35 need not form a perfect arc, but may curve in arc shapes having a plurality of curvatures, as in an elliptic arc. It is also unnecessary that the loading/unloading 35 curve in an arc shape, provided that the loading/unloading 35 is asymptotic to a horizontal plane outside the main casing 4 (the lower casing 8).

In a modified embodiment, the guiding member 31 may have a flat front guiding inner surface and a flat rear guiding inner surface, if a pair of the neighboring guiding members provides a curved loading path to load/unload the cartridge.

As described above, it is sufficient to allocate a space for loading and unloading the cartridge with respect to the main casing, the space having a width slightly greater than the width of the cartridge in the direction orthogonal to the loading/unloading path (the width of the cartridge in a direction orthogonal to the access opening when the cartridge is positioned along the lading/unloading path outside the main casing). As a result, the space occupied by the cartridge can be reduced, thereby increasing the flexibility for choosing an installation location.

Additionally, the cartridge can be smoothly loaded in or unloaded from the main casing. Accordingly, flexibility for choosing installation locations for the image-forming device can be increased while ensuring smooth mounting and removal of the cartridge.

It is possible to reduce the cross section of the loading/unloading path So load and unload the cartridge. Therefore, the size of the main casing can be reduced, and the space allocated on the outside of the main casing for loading and unloading the cartridge can be reduced. As a result, it is possible to further reduce the space occupied by the image-forming device and to further increase the freedom of choice in installation locations. Further, the casing of the cartridge can be smoothly mounted in or removed from the main casing, even when the casing of the cartridge is formed of a size large enough to contact guiding members. Accordingly, a large casing may be used, enabling the casing to accommodate a greater amount of developer, for example, when developer is accommodated in the casing.

A user can access the inside of the main casing through the top thereof in order to mount and remove the cartridge, thereby improving operability.

It is possible to prevent the cover from interfering with the loading/unloading path when the cover is opened. Accordingly, a cover provided for exposing or covering the cartridge access opening need not be opened widely when mounting and removing the cartridge, thereby reducing the space occupied by the image-forming device and increasing the freedom of choice in installation locations.

The cover can be opened and closed from the front surface side of the main casing. Further, a user can access the main casing from the top in order to mount and remove the cartridge. Further, the cartridge can be removed from the main casing by pulling the cartridge in a direction toward the front surface of the image-forming device, thereby further improving operability.

It is possible to reduce the space required for loading and unloading the process cartridge that is frequently exchanged. Accordingly, the installation space required for the image-forming device can be more effectively reduced.

As described above, a plurality of the process cartridges is laid out in a tandem structure in which the process cartridges are parallel to one another and arranged in one direction, while enabling neighboring process cartridges to be mounted and removed without interfering with each other. Further, it is possible to reduce the space occupied by the image-forming device and to increase the flexibility in choosing an installation location.

It is possible to reduce the width of the loading/unloading path more than a construction in which the inclination of the developing rollers changes at different positions along the loading/unloading path when the process cartridge is mounted or removed. Therefore, it is possible to reduce the size of the main casing and to reduce the space required outside the main casing for mounting and removing the cartridges. As a result, the space occupied by the image-forming device can be further reduced, ;hereby increasing the flexibility in choosing an installation location.

Freedom for choosing an installation location can be increased, even when the image-forming device includes a scanner.

It is possible to reliably load and unload cartridges through the cartridge access opening formed in the main casing by disposing the scanner opposite the prescribed surface, without allocating a large space between the main casing and the scanner.

By forming the loading/unloading path for the cartridge in an arc shape, the cartridge can be smoothly mounted and removed along this loading/unloading path. Further, since the width of the loading/unloading path in a direction orthogonal to the mounting and removing direction of the cartridge can be reduced, it is possible to reduce the size of the main casing.

What is claimed is:

1. An image-forming device comprising: a main casing having a cartridge access opening and a cartridge loading section in communication with the cartridge access opening, the cartridge access opening having an opening plane; a cartridge that is detachably mounted in the cartridge loading section through the cartridge access opening; and a guiding unit that provides a loading path to load/unload the cartridge with respect to the cartridge loading section, the guiding unit being configured to orient the loading path toward a direction substantially parallel to the opening plane outside of the main casing, thereby curving a track of the cartridge.

2. The image-forming device according to claim 1, wherein the cartridge comprises a casing having an outer shape that curves in conformance with the loading path.

3. The image-forming device according to claim 2, wherein the guiding unit allows the cartridge to guide, while the cartridge is slid along the guiding unit.

4. The image-forming device according to claim 1, wherein the opening plane is oriented upward when the image-forming device is disposed in an orientation for usage thereof.

5. The image-forming device according to claim 1, further comprising: a cover member that pivotably opens and closes the cartridge access opening; a hinge that couples the cover member to the main casing, the hinge being provided on an opposite side of the main casing to an extending direction of the loading path.

6. The image-forming device according to claim 5, wherein the cartridge access opening is formed in an upper part of the main casing; and the hinge is provided on a rear side with respect to the cartridge access opening.

7. The image-forming device according to claim 1, wherein the cartridge is a process cartridge comprising a process member used in an image-forming process.

8. The image-forming device according to claim 7, wherein the process cartridge comprises a plurality of process cartridges arrayed in one direction so that one end of each process cartridge faces the cartridge access opening, the plurality of process cartridges including a developer of different color from each other for the image-forming process.

9. The image-forming device according to claim 8, wherein the process member comprises a developing roller for carrying a developer, the developing roller having a rotary shaft; and the process cartridges are mounted in the cartridge loading section so that the developing rollers being loaded along the loading path are parallel to each other.

10. The image-forming device according to claim 1, further comprising a scanner having an original support surface extending horizontally, the scanner reading an original placed on the original support surface.

11. The image-forming device according to claim 10, wherein the scanner is disposed in confrontation with the cartridge access opening.

12. An image-forming device comprising: a main casing having a cartridge access opening and a cartridge loading section in communication with the cartridge access opening; a plurality of cartridges that are detachably mounted through the cartridge access opening and arrayed in one direction in the cartridge loading section so that one end of each cartridge faces the cartridge access opening; and a guiding unit that provides a loading path to load/unload each of the plurality of cartridges with respect to the cartridge loading section, the guiding unit orienting the loading path toward the one direction out of the main casing, thereby curling a track of each of the plurality of cartridges.

13. The image-forming device according to claim 12, wherein each of the plurality of cartridges comprises a casing having an outer shape that curves in conformance with the loading path.

14. The image-forming device according to claim 13, wherein the guiding unit allows the plurality of cartridges to guide, while sliding each of the plurality of cartridges.

15. The image-forming device according to claim 12, wherein the cartridge access opening has an opening plane, the opening plane being oriented upward when the image-forming device is disposed in an orientation for usage thereof.

16. The image-forming device according to claim 12, further comprising: a cover member that pivotably opens and closes the cartridge access opening; a hinge that couples the cover member to the main casing, the hinge being provided on an opposite side of the main casing to an extending direction of the loading path.

17. The image-forming device according to claim 16, wherein the cartridge access opening is formed in an upper part of the main casing; and the hinge is provided on a rear side with respect to the cartridge access opening.

18. The image-forming device according to claim 12, wherein each of the plurality of cartridges is a process cartridge comprising a process member used in an image-forming process.

19. The image-forming device according to claim 18, wherein the process member comprises a developing roller for carrying a developer, the developing roller having a rotary shaft; and the process cartridges are mounted in the cartridge loading section so that the developing rollers being loaded along the loading path are parallel to each other.

20. The image-forming device according to claim 12, further comprising a scanner having an original support surface extending horizontally, the scanner reading an original placed on the original support surface.

21. The image-forming device according to claim 20, wherein the scanner is disposed in confrontation with the cartridge access opening.

22. A cartridge loadable in an image-forming device, comprising a casing having a first surface and a second surface opposing the first surface by a distance, wherein the first and second surfaces have a concentric are cross-section in a loading direction.

23. The cartridge according to claim 22, wherein the first and second surfaces slide along a guiding unit provided in the image-forming device to load/unload the cartridge with respect to a cartridge loading section in the image-forming device.

24. The cartridge according to claim 22, wherein the casing has an end portion connecting the first and second surfaces, further comprising a handle protruding from the end portion in the loading direction, the handle enabling a user to hold the cartridge.

* * * * *